United States Patent [19]

Ganser et al.

[11] Patent Number: 4,888,524

[45] Date of Patent: Dec. 19, 1989

[54] CIRCUIT FOR OPERATING GAS DISCHARGE LAMPS WITH A PERIODICALLY ALTERNATING LAMP CURRENT

[76] Inventors: Hans-Günther Ganser, Brockenberg 7a, 5190 Stolberg; Ralf Schäfer, Büchel 34, 5100 Aachen; Hans-Peter Stormberg, Weissdornweg 52, 5190 Stolberg, all of Fed. Rep. of Germany

[21] Appl. No.: 158,082

[22] Filed: Feb. 16, 1988

Related U.S. Application Data

[63] Continuation of Ser. No. 860,272, May 6, 1986, abandoned.

[30] Foreign Application Priority Data

May 13, 1985 [DE] Fed. Rep. of Germany ..... 3517248

[51] Int. Cl.[4] ..... H05B 37/00

[52] U.S. Cl. ..... 315/200 R; 315/224; 315/227 R; 315/209 R; 315/244

[58] Field of Search ..... 315/249, 224, 244, 209, 315/208, 205, 207, 307, 227 R, 263, 200 R

[56] References Cited

U.S. PATENT DOCUMENTS

| | | | |
|---|---|---|---|
| 3,265,930 | 8/1966 | Powell | 315/207 |
| 3,801,867 | 4/1974 | West et al. | 315/DIG. 5 |
| 3,913,002 | 10/1975 | Steigerwald | 315/283 |
| 4,042,856 | 8/1977 | Steigerwald | 315/246 |
| 4,045,709 | 8/1977 | Morais | 315/246 |
| 4,051,411 | 9/1977 | Knoble et al. | 315/246 |

*Primary Examiner*—Leo H. Boudreau
*Assistant Examiner*—Michael Razavi
*Attorney, Agent, or Firm*—Thomas A. Briody

[57] ABSTRACT

A circuit arrangement for operating at least one gas discharge lamp (5) with a periodically varying lamp current and adapted for connection to an alternating voltage source with a period N. The circuit is provided with a controlled semiconductor switch (3) and a control circuit for switching the controlled semiconductor switch with a switching period S in dependence upon a comparison between an actual signal proportional to the lamp current and a nominal signal derived from a voltage across the switching transistor (3).

23 Claims, 1 Drawing Sheet

CIRCUIT FOR OPERATING GAS DISCHARGE LAMPS WITH A PERIODICALLY ALTERNATING LAMP CURRENT

This is a continuation of application Ser. No. 860,272, filed May 6, 1986.

BACKGROUND OF THE INVENTION

This invention relates to a circuit arrangement for operating at least one discharge lamp with a periodically varying lamp current and suitable for connection to an alternating voltage source with a period duration N. This arrangement is provided with a controlled semiconductor switch and a control circuit for switching the controlled semiconductor switch with a switching period duration S in dependence upon a comparison between an actual signal proportional to the lamp current and a nominal signal.

The term "switching period duration S" is to be understood to mean in this description and the appended claims the time duration between two successive instants at which the semiconductor switch becomes conducting and non-conducting, respectively.

The term "periodically current" is to be understood to mean a pulsatory direct current, an alternating current as well as combinations of these two currents, an associated frequency lying in the frequency range from 1 kHz to 500 kHz, preferably from 20 kHz to 150 kHz.

It is usual that gas discharge lamps and circuit arrangements for operating such lamps are fed by means of an alternating voltage source, the alternating voltage having a comparatively low frequency. The frequency is generally 50 Hz to 60 Hz, but frequencies up to 500 Hz may be used.

A circuit arrangement of the kind described in the opening paragraph is known from U.S. Pat. No. 4,042,856.

In the known circuit arrangement, the controlled semiconductor switch forms part of a down converter and the control circuit comprises a comparator with hysteresis for comparing the actual signal with the nominal signal in such a manner that at a preadjusted value of the difference between these two signals the controlled semiconductor switch is switched to the conducting and to the non-conducting state, respectively.

In the use of circuit arrangements of the kind mentioned in the opening paragraph, the requirement is imposed to derive from the alternating voltage source a highly sinusoidal current. In the known circuit arrangement, this is achieved in that the nominal signal has a slightly smoothed rectified sinusoidal form with a repetition frequency which is twice the frequency of the alternating voltage source. The nominal signal is then obtained in that via a transformer a voltage is derived from the alternating voltage source and this voltage is then rectified by means of a rectifier. The use of a transformer is required in order to obtain a nominal signal which is electrically isolated from the alternating voltage source and can thus be brought without difficulty to a potential desired for the control circuit.

Another possibility to obtain a nominal signal electrically isolated from the alternating voltage source consists in that an opto-electronic coupling element is used. The said ways of obtaining electric isolation have the disadvantage that it is necessary to use additional elements in the circuit arrangement, which renders the circuit arrangement more complicated and more expensive.

SUMMARY OF THE INVENTION

An object of the invention is to provide a means for obtaining a comparatively simple circuit arrangement while omitting electric isolation elements and maintaining a favourable form of a current to be derived from the alternating voltage source.

For this purpose, a circuit arrangement of the kind mentioned in the opening paragraph is characterized in that in the operating condition of the lamp the nominal signal is at least derived from a voltage across the controlled semiconductor switch.

It is a surprise to find that a nominal signal thus derived in a simple manner is suitable for ensuring that a highly sinusoidal current is derived from the supply source.

In a preferred embodiment, the controlled semiconductor switch is shunted by a series arrangement of a first resistor and a second resistor and a capacitor is connected parallel to the first resistor, while a junction point between the first and the second resistor serves to derive the nominal signal. An advantage of this embodiment is that peak-shaped voltage pulses in the voltage across the said switch, which occur due to the high switching frequency of the controlled semiconductor switch, are filtered out of the nominal signal derived therefrom, as a result of which a possibly unstable operation of the circuit arrangement is counteracted. The capacitor provides the desired filtering.

In order to guarantee a satisfactory filtering, in a further embodiment of the circuit arrangement according to the invention, each time constant associated with the charging and discharging of the capacitor in combination with the first and the second resistor is larger than the switching period duration S and smaller than the period duration N. When the time constants are chosen to be smaller than the period duration N, it is achieved that the nominal signal can be varied in this period duration N, which is required when a sinusoidal current is to be derived from the alternating voltage source.

In the case where controlled semiconductor switch is fed with a rectified voltage derived from the alternating voltage source, each of the time constants is preferably chosen to be smaller than N/2.

The requirement that a highly sinusoidal current be derived from the alternating voltage source can be fulfilled even more satisfactorily in that in a further embodiment the nominal signal also contains a direct voltage signal. Especially in the proximity of the zero passage of the current a closer approximation of the sinusoidal waveform then is obtained.

Preferably, a circuit arrangement according to the invention comprises a coil having a tapping, with which a rectifier is connected in series, this combination of coil and rectifier serving to form the direct voltage signal. This circuit arrangement has the advantage that a desired direct voltage is formed in a very simple manner.

BRIEF DESCRIPTION OF THE DRAWINGS

In order that the invention may be readily carried out, it will now be described more fully, by way of example, with reference to the accompanying drawing, in which.

DESCRIPTION OF THE PREFERRED EMBODIMENTS

Figure 1:
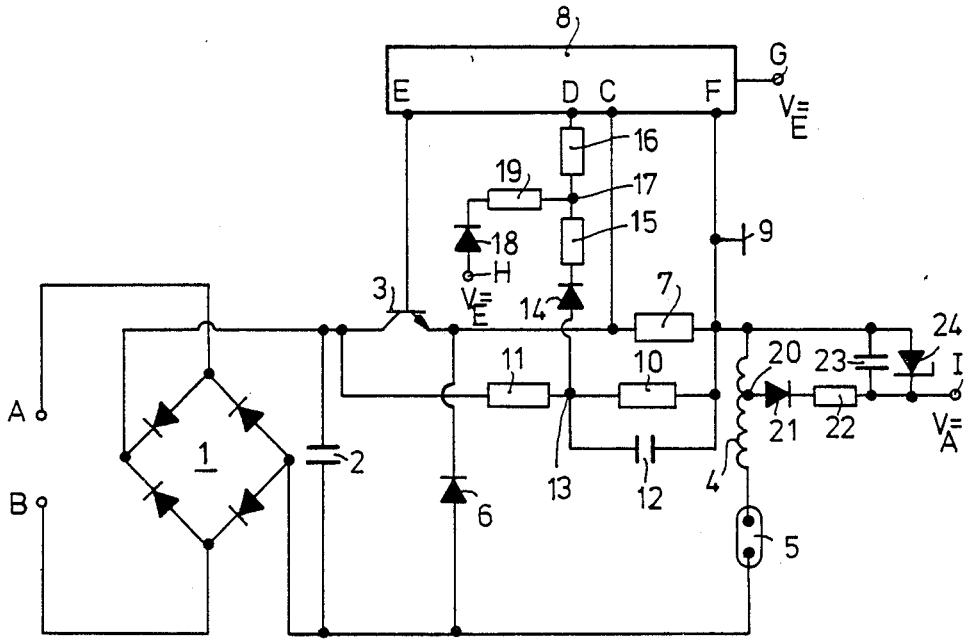
FIG. 1 shows a circuit arrangement according to the invention for operating at least one gas discharge lamp with a periodically alternating lamp current.

In FIG. 1, input terminals for connection to an alternating voltage source of, for example, 220 V, 50 Hz, are designated by A and B. A full-wave rectifier 1 comprising four diodes is connected to these input terminals A and B, as the case may be via a high-frequency filter (not shown). A charging capacitor 2 is connected parallel to the output of this rectifier. A down converter comprising a controlled semiconductor switch 3, a choke coil 4 and a fly-wheel diode 6 is connected in parallel with this charging capacitor 2 to the output of the full-wave rectifier 1. A gas discharge lamp 5 to be operated by the circuit is arranged between the coil 4 and the fly-wheel diode 6. The controlled semiconductor switch 3 consists of a transistor. The charging capacitor 2 serves to facilitate the reignition of the lamp 5. Further, a measuring resistor 7 serving as a current sensor is inserted in series with the connected lamp and this resistor is used to form an actual signal which is proportional to the lamp current and is supplied to an input C of a control circuit 8. In a manner to be described below, the control circuit 8 causes the lamp current to follow a nominal signal that is to be applied to an input D of the control circuit.

The current derived from the alternating voltage source should be highly sinusoidal. According to the invention, a nominal signal supplied to an input D of the control circuit 8 is derived from a voltage across the switching transistor 3. The switching transistor 3 is switched to the conducting and to the non-conducting state, respectively, by a signal applied to its base from an output E of the control circuit 8. A terminal F of the control circuit 8 is connected to the ground conductor 9 of the circuit arrangement. The control circuit 8 is connected via a terminal G to a supply direct voltage $V_E=$.

In order to derive the nominal signal, the switching transistor 3, connected in series with the measuring resistor 7, is shunted by a voltage divider comprising a series arrangement of a first resistor 10 and a second resistor 11, of which the first resistor 10 is connected parallel to a capacitor 12. The nominal signal proportional to the voltage across the switching transistor 3 is then derived as follows. The nominal signal developed at a junction point 13 between the first and the second resistors 10, 11 of the voltage divider is supplied through a diode 14 and a further voltage divider comprising resistors 15 and 16 a nominal signal input D of the control circuit 8.

The value $C_{12}$ of the capacitor 12 in combination with the resistance values $R_{10}$ and $R_{11}$ of the first and second resistors 10 and 11, respectively, is chosen so that each time constant $R_{10}C_{12}$ and $R_{11}C_{12}$, corresponding to the charging and discharging of the capacitor 12 in combination with the first and the second resistors 10 and 11, respectively, is larger than the switching period duration S and is smaller than half the period duration (N/2) of the alternating voltage source. Thus, it is achieved that variations of the nominal voltage because of the high transistor switching frequency are filtered, while at the same time slower variations can become effective.

It has been found that a nominal signal derived in this manner produces a substantially sinusoidal current for the circuit arrangement from the alternating voltage source. When the capacitor 12 is chosen too large, considerable deviations from the sinusoidal waveform can occur, whereas with too small a capacitor 12 oscillations can be produced during operation of the down converter.

In order to further optimize the derivation of current with respect to the sinusoidal waveform, a direct voltage signal can be superimposed on the nominal signal proportional to the voltage across the controlled semiconductor switch 3. This direct voltage signal $V_E=$ is supplied from a terminal point H to a junction point 17 between the two voltage divider resistors 15 and 16 through a diode 18 and a resistor 19. This direct voltage signal may be positive or negative and may vary at a rate which is large as compared with the period duration of the alternating voltage source. The value of the direct voltage signal can be adjusted by a corresponding proportioning of the resistors 15, 16 and 19. The diodes 14 and 18 serve to decouple the direct voltage signal from the voltage of the voltage divider 10 and 11, respectively.

The direct voltage signal superimposed on the nominal signal can be derived at a tapping-point 20 of the choke coil 4 of the down converter. The high-frequency voltage derived from this tapping-point 20 is rectified by a diode 21 and charges a capacitor 23 through a resistor 22. The voltage of this capacitor is stabilized to a value $V_A=$ by means of a Zener diode 24 which is connected to a point I of the circuit arrangement and which can be utilized as a direct voltage source both for the direct voltage signal to be superimposed on the nominal signal and for the direct voltage supply of the control circuit 8 at a point G.

Figure 2:
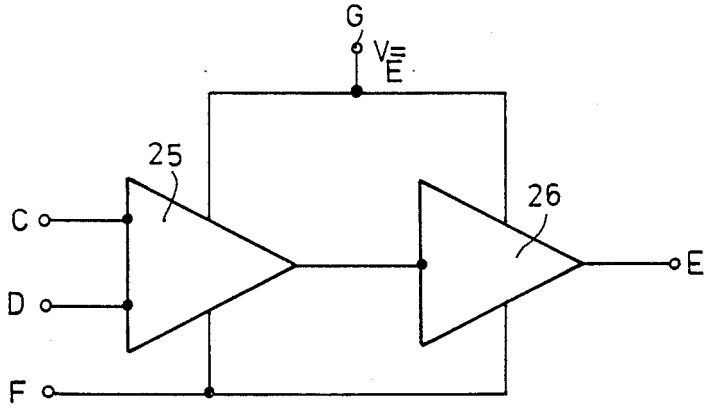
FIG. 2 shows the circuit diagram of a control circuit used in the circuit arrangement shown in FIG. 1.

FIG. 2 shows an embodiment of the control circuit 8 that can be used in the circuit arrangement shown in FIG. 1. This circuit essentially comprises a comparator with hysteresis 25 which is coupled to an amplifier 26. The comparator 25 compares the nominal and actual signals applied to the inputs C and D. When the actual signal reaches the nominal signal plus comparator hysteresis, the controlled semiconductor switch 3 is switched to the non-conducting state by means of the amplifier 26. As a result, the lamp current and hence also the actual signal decreases. When the actual signal reaches the nominal signal minus comparator hysteresis, the comparator 25 again switches via the amplifier 26, the switching transistor 3 to the conducting state, as a result of which the lamp current increases again. Thus, the lamp current always varies within the hysteresis limits about the nominal value.

The voltage divider connected parallel to the controlled semiconductor switch may be composed of more than two resistors. Moreover, the nominal signal need not necessarily be derived at a tapping-point of the voltage divider connected to a capacitor. The first resistor of the voltage divider need not be connected to the measuring resistor either, but may be connected to other points of the circuit arrangement.

Finally, it should be noted that the circuit arrangement according to the invention is not limited to the use as a down converter, but may also be constructed, for example, as a boost converter, a bridge or half-bridge circuit or a pushpull converter.

In an embodiment for operating a 30 W high-pressure sodium vapour discharge lamp with a lamp operating voltage of about 50 V, the essential components of the circuit arrangement had the following values:

| | |
|---|---|
| Capacitor 2 | 1 μF |
| capacitor 12 | 10 nF |
| resistor 7 | 1 Ω |
| resistor 10 | 10k Ω |
| resistor 11 | 100k Ω |
| resistor 15 | 1.8k Ω |
| resistor 16 | 1k Ω |
| resistor 19 | 3.3k Ω |
| choke coil 4 | 1 mH |
| direct voltage at point I | 5 V. |

In the embodiment described, the semiconductor switch is a switching transistor. However, the invention is not limited to switching transistors, but may also make use of, for example, thyristors, triacs and GTO's.

What is claimed is:

1. A circuit arrangement for operating at least one discharge lamp with a periodically varying lamp current and adapted for connection to an alternating voltage source having a period duration N, the circuit arrangement comprising: a controlled semiconductor switch coupled to said alternating voltage source and said discharge lamp so as to control the flow of a periodically varying current to the lamp, a control circuit for switching the controlled semiconductor switch with a switching period duration S which depends upon a comparison between an actual signal proportional to the lamp current and a nominal signal, and means for deriving, during operation of the lamp, the nominal signal from a voltage produced across the controlled semiconductor switch.

2. A circuit arrangement as claimed in claim 1, characterized in that the controlled semiconductor switch is shunted by a series arrangement of a first resistor and a second resistor, in that a capacitor is connected parallel to the first resistor and in that the nominal signal is derived at a junction point between the first and the second resistor.

3. A circuit arrangement as claimed in claim 2, characterized in that the capacitor has a charge time constant and a discharge time constant corresponding to charging and discharging of the capacitor in conjunction with the first and the second resistor, each said time constant being larger than the switching period duration S and smaller than the period duration N.

4. A circuit arrangement as claimed in claim or 3, characterized in that the nominal signal also contains a direct voltage signal.

5. A circuit arrangement as claimed in claim 4, characterized in that the circuit arrangement further comprises a coil with a tapping connected, in series with a rectifier, and in that the combination of coil and rectifier serves to produce the direct voltage signal.

6. A circuit arrangement as claimed in claim 1 wherein said nominal signal deriving means includes means for producing a direct voltage signal so that said nominal signal includes the voltage produced across the semiconductor switch and said direct voltage signal.

7. A circuit arrangement as claimed in claim 6 wherein said direct voltage producing means comprises an inductor coupled to the semiconductor switch and a rectifier coupled to the inductor to derive said direct voltage signal at an output of the rectifier.

8. A circuit arrangement as claimed in claim 2 wherein the first resistor and the capacitor form a first RC circuit with a time constant and the second resistor and the capacitor form a second RC circuit with a time constant, each of said time constants being greater than the switching period S and smaller than the alternating voltage period N.

9. A circuit arrangement as claimed in claim 1 wherein the control circuit includes means for comparing said actual signal and said nominal signal to supply a switching signal to a control electrode of the semiconductor switch so as to switch it on and off whereby said voltage produced across the semiconductor switch has a non-sinusoidal waveform, said semiconductor switch causing an approximately sinusoidal periodically varying current to flow from the alternating voltage source to the discharge lamp.

10. A circuit for energizing at least one discharge lamp with a periodically varying lamp current comprising: a pair of input terminals for connection to an AC voltage source having a period N, a controlled semiconductor switch, first means coupling the semiconductor switch to said input terminals, means for connecting a discharge lamp to the semiconductor switch so that the semiconductor switch controls the flow of a periodically varying current to the lamp, a control circuit having input means for receiving an actual signal proportional to the lamp current and for receiving a nominal signal derived from a voltage produced across the semiconductor switch during operation of a lamp, said control circuit including means for comparing the actual signal and the nominal signal to produce at an output of the control circuit a high frequency switching signal having a period S and determined by a comparison between the actual signal and the nominal signal, and second means coupling a control electrode of the semiconductor switch to the output of the control circuit thereby to switch the semiconductor switch at the switching period S.

11. A circuit as claimed in claim 10 wherein the first coupling means comprises a full wave rectifier having input terminals coupled to said pair of input terminals and output terminals coupled to said semiconductor switch and to the discharge lamp, and a capacitor connected across the rectifier output terminals to produce a pulsatory direct voltage for the semiconductor switch.

12. A circuit as claimed in claim 11 further comprising an inductor and a flywheel diode and second means connecting the inductor and flywheel diode in circuit with the semiconductor swtich to form a high frequency down converter for producing a periodically varying lamp current with the period S.

13. A circuit as claimed in claim 12 wherein said second connecting means is adapted to connect the semiconductor switch, the inductor and the lamp in a series circuit across the capacitor, a diode coupled to a tap point on the inductor to derive a DC signal component, and means for coupling said DC signal component to said control circuit input means as a component of the nominal signal.

14. A circuit as claimed in claim 10 wherein said nominal signal is derived by means of first and second resistors connected in a series circuit that is coupled in shunt with the semiconductor switch and a capacitor connected in parallel with the first resistor, said nominal signal being derived at a junction point between the first and second resistors.

15. A circuit as claimed in claim 14 wherein the first resistor and the capacitor form a first RC circuit with a time constant and the second resistor and the capacitor form a second RC circuit with a time constant, each said time constant being greater than the switching period S and smaller than half the alternating voltage period N.

16. A circuit as claimed in claim 14 wherein said connecting means connects an inductor in series with the discharge lamp and the semiconductor switch, a rectifier and a capacitor coupled to a tap point on the inductor to derive a DC signal component at a junction point of the rectifier and capacitor, and means for coupling said DC signal component to a supply voltage input of the control circuit and to said control circuit input means so as to superimpose the DC signal component on the nominal signal.

17. A circuit as claimed in claim 14 further comprising an inductor and a flywheel diode and second means connecting the inductor and flywheel diode in circuit with the semiconductor switch to form a high frequency converter with the inductor and lamp connected in a series circuit with the semiconductor switch, and wherein the control circuit comprises a comparator with hysteresis having first and second input terminals that constitute the control circuit input means, the first of said comparator input terminals being connected to said junction point of the first and second resistors and the second comparator input terminal being connected to a circuit point in said series circuit at which said actual signal is developed, and means coupling an output of the comparator to said control circuit output.

18. A circuit as claimed in claim 11 further comprising an inductor and a flywheel diode with the connecting means connecting the inductor and flywheel diode in circuit with the semiconductor switch to form a high frequency converter, and wherein said nominal signal is derived by means of first and second resistors connected in a series circuit that is coupled in shunt with the semiconductor switch and a capacitor connected in parallel with the first resistor, said nominal signal being derived at a junction point between the first and second resistors.

19. A circuit as claimed in claim 11 further comprising an inductor and a flywheel diode and wherein the connecting means connects the inductor and flywheel diode in circuit with the semiconductor switch to form a high frequency converter, and a diode coupled to a tap point on the inductor to derive a DC signal component, and means for coupling said DC signal component to said control circuit input means as a component of the nominal signal.

20. A circuit as claimed in claim 11 wherein said nominal signal is derived by means of resistor means and a filter capacitor that filters out high frequency variations of the nominal signal produced by high frequency switching of the semiconductor switch thereby to derive for the circuit an approximately periodically varying sinusoidal current from the AC voltage source.

21. A circuit for operating a discharge lamp comprising:

a pair of input terminals for connection to a sinusoidal AC voltage source, a controlled semiconductor switch, first means coupling the semiconductor switch in series circuit with a discharge lamp across said input terminals whereby the semiconductor switch controls the flow of a periodically varying current to the lamp, first means for deriving, during operation of a lamp, a nominal signal from a voltage produced across the controlled semiconductor switch, second means for deriving an actual signal determined by lamp current, a control circuit including means for comparing the actual signal and the nominal signal to produce at an output of the control circuit a high frequency switching signal, and second means coupling a control electrode of the semiconductor switch to the output of the control circuit whereby said circuit draws a sinusoidal line current from the AC voltage source as the semiconductor switch is switched at said high frequency.

22. A circuit as claimed in claim 21 wherein said first deriving means includes an RC filter that filters out high frequency components of the nominal signal.

23. A circuit as claimed in claim 21 further comprising means for generating a DC signal component, and means for combining the DC signal component with the nominal signal as one input to said comparing means.

* * * * *